United States Patent [19]

Rose

[11] Patent Number: 4,882,967

[45] Date of Patent: Nov. 28, 1989

[54] TREMOLO APPARATUS HAVING BROKEN STRING COMPENSATION FEATURE

[76] Inventor: Floyd D. Rose, 5610 145th Ave., SE., Bellevue, Wash. 98006

[21] Appl. No.: 184,292

[22] Filed: Apr. 21, 1988

[51] Int. Cl.[4] ..... G10D 3/14

[52] U.S. Cl. ..... 84/313

[58] Field of Search ..... 84/313

[56] References Cited

U.S. PATENT DOCUMENTS

| | | | |
|---|---|---|---|
| 2,972,923 | 2/1961 | Fender | 84/313 |
| 3,326,072 | 6/1967 | Price | 84/313 |
| 4,137,812 | 2/1979 | Franzmann | 84/313 |
| 4,317,403 | 3/1982 | Franzmann | 84/313 |
| 4,475,432 | 10/1984 | Stroh | 84/314 N |
| 4,632,005 | 12/1986 | Steinberger | 84/313 |
| 4,638,711 | 1/1987 | Stroh | 84/313 |
| 4,643,070 | 2/1987 | Petrillo | 84/313 |
| 4,674,389 | 6/1987 | Fender | 84/313 |
| 4,697,493 | 10/1987 | Ralston | 84/313 |

*Primary Examiner*—Lawrence R. Franklin
*Attorney, Agent, or Firm*—Lerner, David, Littenberg, Krumholz & Mentlik

[57] ABSTRACT

An improved tremolo apparatus for stringed musical instruments is provided. The improved tremolo apparatus comprises a tremolo means to which a plurality of strings of the musical instrument are adapted to be secured for movement therewith; a means for mounting the tremolo means on the stringed musical instrument for movement from a first position to a second position to simultaneously decrease the tension of the plurality of the strings, and for movement from the first position to a third position to simultaneously increase the tension of the plurality of strings; a means for moving the tremolo means from the first position towards the second position and for moving the tremolo means from the first position towards the third position; a means for biasing the tremolo means in a direction to return the tremolo means to the first position when the tremolo means is moved towards the second position; and, a stop member movable between an inactive position, at which it is out of engagement with the tremolo means, and an active position at which it is in engagement with the tremolo means when the latter is at its first position. The stop member and the tremolo means are constructed and arranged so that when the stop member is in its active position, it precludes movement of the tremolo means from the first position toward the third position but allows movement of the tremolo means from the first position toward the second position.

8 Claims, 2 Drawing Sheets

TREMOLO APPARATUS HAVING BROKEN STRING COMPENSATION FEATURE

FIELD OF THE INVENTION

This invention relates to tremolo apparatus for stringed musical instruments and, more particularly, to such tremolo apparatus having provision therein to allow immediate retuning of the unbroken strings of a stringed musical instrument when one of the strings thereof breaks during a performance.

BACKGROUND OF THE INVENTION

Tremolo devices for stringed musical instruments are widely known. They are used to simultaneously and significantly either reduce or increase the tension on all strings of the musical instrument, to thereby produce unusual tone variations or vibrato. Examples of tremolos are shown in U.S. Pat. No. 2,741,146 to Fender and in U.S. Pat. No. 4,497,236 to Floyd Rose, one of the inventors named herein.

As used in connection with, for example, an electric guitar having a body, a neck portion and a plurality of strings, each of which is anchored at one end to the neck portion of the guitar and extends rearwardly to and over a portion of the body of the guitar, a typical tremolo device includes a base plate that is pivotally mounted on the guitar body and has string attachment means thereon to which the other ends of the strings are anchored. The strings are anchored to the attachment means at points in a plane above the level of the plane of the base plate, with both planes being generally parallel to the plane of the guitar body. The typical tremolo device also includes a flange member integral with the base plate that extends downwardly into a cavity in the body of the guitar, at approximately a right angle to the base plate. It also includes a plurality of springs connected at one of their ends to the lower end of the flange member and at the other of their ends to a wall of the cavity in the guitar body. The arrangement is such that the tension in the strings and the bias of the springs counterbalance one another when the strings are in tune and the base plate of the tremolo device is stationary at a neutral first position. A tremolo bar that is fixed to the base plate is also provided to allow the user to manually pivot the base plate relative to the guitar body, either toward a second position at which the tension in the strings is reduced and the tone of the guitar shifts in the flat direction, or towards a third position at which the tension in the strings is increased and the tone of the guitar shifts in the sharp direction.

Should one of the strings of the guitar break during a performance being given by a user of the guitar, the balance theretofore existing between the tension in the unbroken strings and the bias of the strings of the tremolo device is disturbed, and the base plate of the tremolo device pivots downwardly under the bias of the springs until the tension in the remaining unbroken strings again counterbalances the bias of the strings. Thus, the individual tensions in the remaining unbroken strings increase and the tones of the strings all shift in the sharp direction, creating a performance problem for the user who must either stop the performance for a sufficient time either to obtain a new guitar or to retune the remaining strings of the guitar in hand, both of which are time consuming procedures.

It is, therefore, a primary object of the present invention to provide an improved tremolo apparatus having provision therein to allow immediate retuning of unbroken strings of a stringed instrument when one of the strings thereof breaks during a performance.

It is another object of the present invention to provide such a tremolo apparatus in which the tremolo base plate can be quickly returned to and held at its original neutral first position following the breakage of a string in the instrument so that the user's performance can be continued with only a minor interruption.

A further object of the present invention is to provide such a tremolo apparatus which, in addition to allowing the tremolo base plate to be returned to its original neutral first position following a string break, allows the tremolo apparatus to continue to be used with respect to shifting the base plate toward its second position, whereat the remaining unbroken strings are shifted in the flat direction.

Further objects and advantages of this invention will become apparent as the following description proceeds.

SUMMARY OF THE INVENTION

Briefly stated, and in accordance with one embodiment of this invention, an improved tremolo apparatus for stringed musical instruments comprises a tremolo means to which a plurality of strings of the musical instrument are adapted to be secured for movement therewith; a means for mounting the tremolo means on the stringed musical instrument for movement from a first position to a second position to simultaneously decrease the tension of the plurality of the strings, and for movement from the first position to a third position to simultaneously increase the tension of the plurality of strings; a means for moving the tremolo means from the first position towards the second position and for moving the tremolo means from the first position towards the third position; a means for biasing the tremolo means in a direction to return the tremolo means to the first position when the tremolo means is moved towards the second position; and, a stop member movable between an inactive position, at which it is out of engagement with the tremolo means, and an active position at which it is in engagement with the tremolo means when the latter is at its first position. The stop member and the tremolo means are constructed and arranged so that when the stop member is in its active position, it precludes movement of the tremolo means from the first position toward the third position but allows movement of the tremolo means from the first position toward the second position.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION OF THE INVENTION

Figure 1:
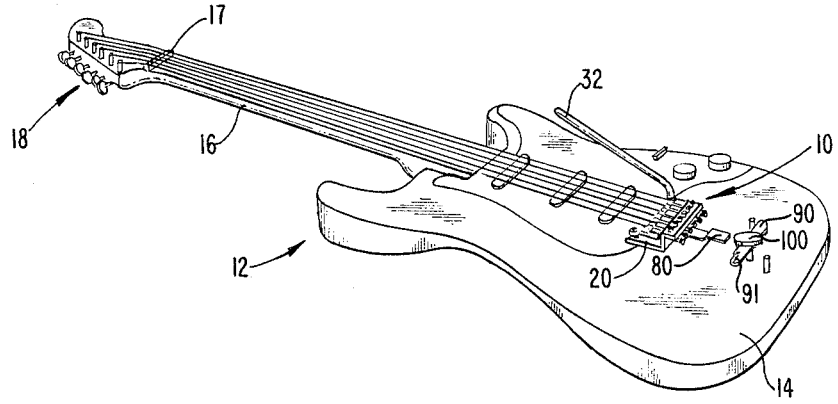
FIG. 1 is aperspective view showing the tremolo apparatus of invention in position on an electric guitar type of stringed musical instrument.

Referring to FIG. 1, the tremolo apparatus of the present invention has been shown generally at 10 as the bridge element 20 of an electric guitar, shown generally at 12. The guitar 12 comprises generally a body 14 and a neck 16. Near the top of neck 16 is a nut element 17, and beyond that several tuning pegs 18, one for each string of the guitar, are provided.

Although the present invention is shown in use on an electric guitar, it should be understood that the invention can be used on other stringed musical instruments, including for example banjos, ukeleles, mandolins, lutes, violins, cellos, and even pianos. The invention will probably have its greatest use, however, on a guitar and hence it is so described. Further, although the present invention is described and shown in connection with a tremolo apparatus which incorporates the function of a bridge element having separate fine tuning adjustments for each of the strings thereon, it should be understood that the invention could be used in conjunction with a tremolo device that does not incorporate the bridge element and individual string fine tuning therein.

Figure 2:
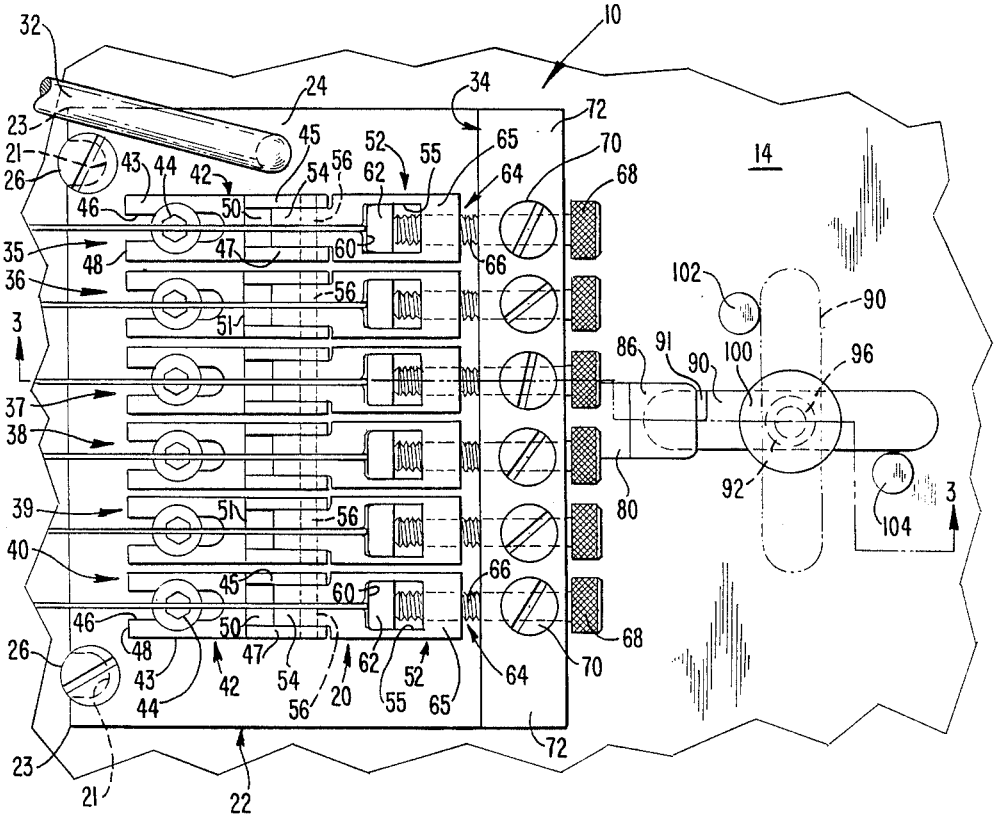
FIG. 2 is an enlarged plan view, with parts omitted for clarity, of the tremolo apparatus shown in FIG. 1.
Figure 3:
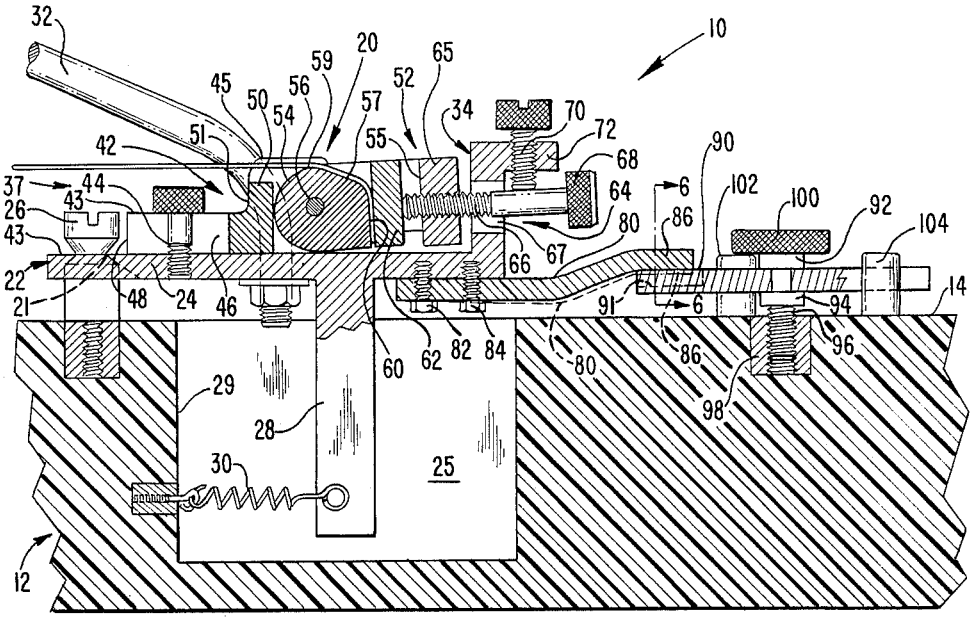
FIG. 3 is a sectional elevation view of the tremolo apparatus, taken along the line 3—3 of FIG. 2, with parts omitted and parts broken away for clarity.

FIGS. 2 and 3 show the present invention in greater detail. Referring specifically to those figures in conjunction with FIG. 1, the invention is shown in use with a tremolo apparatus in the operation of which the bridge element 20 is tilted relative to the body 14 of the guitar to momentarily significantly change the pitch of the guitar strings. The bridge element and fine tuning features of the tremolo apparatus 10 have been disclosed in detail and covered in the aforementioned U.S. Pat. No. 4,497,236, the disclosure of which is incorporated herein by reference, and only a general description of such features will be included in this description. Thus, the tremolo apparatus 10 includes a tremolo base element, shown generally at 22, a primary part of which is a flat plate 24 which is generally aligned parallel to the top surface of the guitar. Flat plate 24 includes a knife edge section 21 adjacent each of its forward corners 23. The knife edge sections mate with a tapered groove in an upstanding position screw 26 which is fixed to the body 14 of the guitar. At the rear of the flat plate 24, a flange 28 extends downwardly into a cavity 25 formed in body. The bottom of the flange 28 is connected to one of the walls 29, which form the cavity 25, by one or more horizontal springs 30.

A tremolo bar 32 is secured to flat plate 24 near one longitudinal edge thereof (the right edge as viewed in FIG. 1, looking toward the neck 16 of the guitar). When tremolo bar 32 is moved towards body 14 of the guitar, tremolo base element 22 pivots or tilts upwardly about the two fixed positioned screws 26, against the action of springs 30. This action significantly changes the original pitch tune of the instrument, in a flat direction, and facilitates an increased range of sounds for the instrument. When the original pitch tune is again desired, tremolo bar 32 is released and the springs 30 return the tremolo base element 22 to its original neutral position, which returns the bridge element 20 and the strings to their original condition. Similarly, when tremolo bar 32 is moved away from body 14 of the guitar, tremolo base element 22 pivots or tilts downwardly about the two fixed positioned screws 26, increasing the tension in the guitar strings. This action again significantly changes the original pitch tune of the instrument, in a sharp direction. When the tremolo bar 32 is again released, the increased tension in the strings returns the tremolo bridge element 20 to its original neutral position, returning the bridge structure and strings to their original condition.

Tremolo base element 22 further includes an upstanding L-shaped flange, shown generally at 34, which extends upwardly from the rear edge of flat plate 24 and which has a width which is somewhat greater than the distance between the two outside strings on the instrument, i.e., the high E and low E strings, so that the flange 34 is slightly wider than the set of strings.

As shown in FIG. 2, each of the strings is provided with separate, corresponding fine tuning elements, shown generally at 35, 36, 37, 38, 39 and 40. Each of the fine tuning elements 35-40 includes a forward block element, shown generally at 42, and a rear block element, shown generally at 52.

Forward block element 42 includes a front plate-like section 43 which has a slot 46 therein that extends rearwardly from the front edge 48 thereof and is located approximately at a mid-width point thereof. Slot 46 is wide enough to accommodate a machine screw 44, which is threaded into flat plate 24, and which clamps the forward block element 42 against plate 24. Loosening machine screw 44 permits longitudinal movement of forward block element 42, rear block element 52, and associated parts, for harmonic tuning of the strings.

The rear section of the forward block element 42 extends above the front plate-like section 43, but is cut out so that it is U-shaped, when viewed from above, opening in the rearward direction. The rear section thus comprises two edge portions 45, 47 which are joined at their forward ends by an intermediate portion 51. The top edge of the intermediate portion 51 is slightly relieved at 50.

The rear block element 52 of each of the fine tuning elements 35–40 is generally rectangular in plan and elevation and is provided with a semi-circular vertical ear portion 54 extending from the front surface thereof. Ear portion 54 has approximately the same width as the distance between the two edge portions 45, 47 of the rear section of forward block element 42, while the full width of rear block element 52 is approximately equal to the distance between the exterior surfaces of edge portion 45, 47.

Aligned circular openings are provided through the two edge portions 45, 47, as well as through ear portion 54 of rear block element 52. A pin 56 is positioned in the openings, and the front and rear surfaces, respectively, of rear block element 52 and forward block element 42 are configured so that rear block element 52 is rotatable relative to forward block element 42 about pin 56.

The rear block element 52 also includes a central opening 55 therein which opens onto both the top surface and the bottom surface of element 52. The interior surface which defines the front or forward configuration of the central opening 55 is preferably radiused in such a manner as to continue the curve of semi-circular ear portion 54 a given distance into the opening, or it may be flat when angled downwardly.

FIG. 3 shows a relatively flat surface 57, angled downwardly from the curved portion of ear portion 54, relative to the axis of rotation about pin 56. Surface 57 extends a short distance rearwardly of the axis of rotation and terminates in a generally vertical flat surface 60, which extends downwardly to the lower surface of rear block 52. The portion of ear 54, surface 57 and flat surface 60 which the string contacts is referred to as the string contact surface. The first part or all of surface 57 could be curved, as well. The string makes initial contact at the top dead center point 59. The string contact surface to the front and rear of point 59 should be curved a sufficient distance, referred to as the critical distance, to permit the range of fine tuning desired so that the string will always be on a curved portion of the string contact surface. Flat surface 57, or an increasing radius portion to the rear of the critical distance portion, results in an increased rearward thickness between pin 56 and surface 60. This increased thickness is helpful to the tuning element in withstanding a clamping action as explained hereinafter. If section 57 is gently curved, the life of the string will be increased. The other interior surfaces defining opening 55 are, in the embodiment shown, vertical and flat, although their configuration is not particularly significant. The rear block element 52 terminates a relatively short distance from the L-shaped flange 34 at the rear of plate 24.

Positioned within opening 55 is a front plate portion 62 of a stringed clamp, shown generally at 64 (FIG. 3). The instrument string is positioned down through opening 55, between surface 60 and the front plate 62. A critical contact point between the string and the rear block 52 occurs in the vicinity of the top dead center of the axis of rotation, i.e., approximately at point 59 in FIG. 3. Thus, the fine tuning element also functions as a bridge for the string.

The forward end of a threaded shank 66 bears against the front plate 62. Threaded shank 66 is threaded through a rear wall 65 of rear block element 52 and then extends through a vertical slot 67 in the L-shaped flange 34. Shank 66 terminates in a head 68, which may be turned by means of an Allen wrench in the embodiment shown to change the pressure against front plate 62 for clamping and unclamping the string. A fine tuning adjustment screw 70 is threaded through a horizontal portion 72 of the L-shaped flange 34 and positioned so that it will contact shank 66. Shank 66 and hence rear block element 52 are free to move a short distance vertically in the vertical slot 67 of L-shaped flange 34. Shank 66 is biased vertically against the bottom of adjustment screw 70 by virtue of the tension in the instrument string itself. The actual vertical position of shank 66, and hence rotational position of rear block element 52, is determined by the position of adjustment screw 70. Screw 70 may be conveniently rotated by hand or by a conventional screwdriver. Threading screw 70 downwardly pushes shank 66 downwardly and rotates rear block element 52 clockwise (FIG. 3). Threading screw 70 upwardly results in an upward movement of the shank 66 and in a counter-clockwise rotation of the rear block element 52.

If the tension on a given string is to be changed, i.e., if the string is to be fine tuned, adjustment screw 70 is moved clockwise (moving downwardly) to increase the string tension and hence string pitch, and counter-clockwise (moving upwardly) to decrease the string tension and hence the string pitch. As the rear block element 52 rotates about pin 56, the critical point of bridge contact of the string remains approximately at point 59, due to the radiused top portion of rear block element 52 and ear 54. Hence the distance between the bridge critical contact point and the nut element 17 at the head end of the guitar remains the same during the fine tuning of the strings, while the string remains clamped, maintaining harmonic tuning of the string.

The foregoing description of the fine tuning arrangement for the tremolo apparatus essentially duplicates the subject matter of U.S. Pat. No. 4,497,236, mentioned earlier herein. It therefore forms no part of the present invention, a detailed description of which follows.

Assuming that the guitar has been properly fine tuned by the tuning pegs 18 and the fine tuning elements 35–40, and that the guitar is in use when one of the strings thereof breaks, the reduced cumulative tension of the strings allows the springs 30 to pivot the base element 22 slightly clockwise about the knife edge sections 21 and position screws 26, as viewed in FIG. 3. In accordance with the present invention the tremolo apparatus 10 includes a tremolo arm member 80 which is bolted to the under surface of the tremolo base element 22 by means of bolts 82, 84. The tremolo arm member 80 includes a rear portion 86 thereon. The tremolo arm member 80 extends in a plane that is essentially co-planar with, or parallel to, the plane of the lower surface of the base element 22. Accordingly, when the base element 22 pivots downwardly slightly due to the breaking of a string of the guitar, the tremolo arm member 80 also moves downwardly from the position shown in solid lines in FIG. 3 to the position shown in broken lines, at which new position a new balance occurs between the cumulative tension in the guitar strings and the bias of springs 30.

Figure 6:
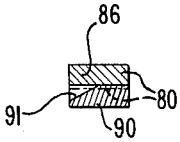
FIG. 6 is a sectional elevation view, taken along the line 6—6 of FIG. 3.

Referring to FIGS. 2, 3 and 6, in order to re-establish the proper tension in the unbroken strings of the guitar, a stop member or arm 90 having a tapered tip portion 91 is provided. Stop member 90 is pivotally mounted between collars 92 and 94 fixed on a threaded screw member 96. The screw member 96 threadedly engages an insert or nut member 98 that is fastened to or embedded in the guitar body 14. The spacing between the upper surface of the guitar body 14 and the stop member 90 is manually adjustable by rotating the threaded screw member 96 via a knurled head 100. Accordingly, the collets 92 and 94 and the screw member 96 and nut member 98, together, comprise a support means including means for adjusting the elevation of the stop member 90 relative to the body 14 of the guitar.

As indicated earlier, the stop member 90 is pivotally mounted relative to the threaded screw member 96. Thus, it is movable between an inactive position, shown in broken lines in FIG. 2, and an active position, shown in solid lines in FIGS. 2 and 3. During normal use of the guitar, when there are no broken strings present, the stop member 90 is rotated to its inactive position, (the broken line position shown in FIG. 2) and held there by a holding means 102 which, in one embodiment of the invention, comprises a magnet that is fastened to the upper surface of, or embedded in the upper portion of, the guitar body 14. In the event of a string breakage during a performance, the user of the instrument need merely pivot the stop member 90 to the latter's solid line position, shown in FIGS. 2 and 3. During such pivotting movement, the tapered tip portion 91 of stop member 90 engages and raises the tremolo arm member 80 from its broken line position back to its solid line position, retuning the remaining unbroken strings. It will, of course, be apparent that the stop member 90 would have been raised to its correct elevation by screw member 96 prior to the start of the concert, in connection with the tuning of the instrument.

Preferably, a second holding means 104, which also may comprise a magnet embedded in or fastened to the upper surface of guitar body 14, is provided adjacent the path of movement of the stop member 90 to hold the stop member 90 in its active position so that when the tremolo bar is depressed during the continuation of the performance, the stop member 90 will not rotate out of its active position notwithstanding that it may no longer be in continuous contact with the rear portion 86 of tremolo arm member 80 when the tremolo bar 32 is depressed.

Figure 4:
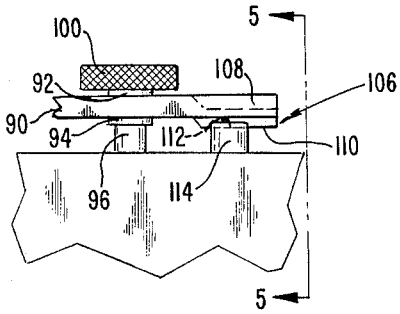
FIG. 4 is a detailed elevation view, with parts omitted and parts broken away for clarity, of a detent arrangement employed in an alternate embodiment of the invention for holding a pivotally mounted stop member at one end of its travel.
Figure 5:
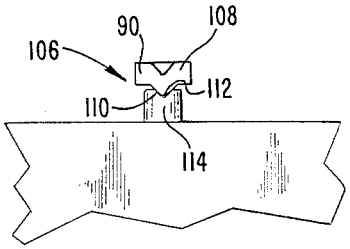
FIG. 5 is a detailed elevation view, taken along the line 5—5 of FIG. 4.

Referring to FIGS. 4 and 5 in conjunction with FIG. 2, the magnetic holding means 102 and 104 positioned adjacent the opposite ends of the path of movement of stop member 90 may be replaced by corresponding detent type holding means, one of which is shown generally at 106 in FIGS. 4 and 5. Thus, in the embodiment of FIGS. 4 and 5 the stop member 90 may be provided with an end portion 108 having a protrusion 110 thereon that engages a depression 112 formed in a post 114 embedded in or otherwise fastened to the guitar body 14. Accordingly, when the stop member 90 is rotated to one end of its path of travel, the protrusion 110 engages with and is held in place by the depression 112 in the post 114 adjacent that end of its path of travel. A similar construction adjacent the other end of the path of travel of stop member 90 is provided to hold arm 90 at the other end of its path of travel.

From the foregoing description, it will be apparent that this invention provides an improved tremolo apparatus having provision therein to allow immediate retuning of unbroken strings of a stringed instrument when one of the strings thereof breaks during a performance. This is accomplished by allowing the tremolo base plate to be returned to and held at the neutral position it originally occupied before the string broke, allowing the user's performance to be continued with only a minor interruption. In additon, after being returned to its original neutral position following a string break, the invention allows the base plate of the tremolo apparatus to continue to be shifted upwardly from the neutral position, allowing the remaining broken strings to be shifted in the flat direction to provide a continuing tremolo effect.

It should also be noted that, in addition to the foregoing advantages, the present invention allows the user to more easily tune a new string when it is being installed in the guitar. This is done by moving the stop member 90 to its active position, whereat it holds the tremolo base plate 22 in its original neutral position, at which all of the unbroken strings are in tune. This allows the user to quickly tune the new string that is being installed. Also, in the event that all of the strings of the guitar should require simultaneous retuning in the flat direction during a performance for one reason or another, the stop member 90 can be moved to its active position in engagement with the tremolo bar member 80 and the adjusting screw 96 can be rotated by hand so as to decrease the tension in and retune all of the strings at the same time during the performance. Similarly, the user can use the adjusting screw 96 to make all of the strings go flat where it is desired to adjust to music that is slightly flat. The fine tuning elements 35–40 would then be used to fine tune each of the strings individually.

While there has been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. In a guitar comprising a tremolo base plate to which the strings of the guitar may be secured, tremolo means for moving the tremolo base plate in a first direction from a tuned position toward the guitar body and in a second direction from the tuned position away from the guitar body to produce tremolo sounds, and a locking member for selectively preventing the tremolo base plate from moving in said first direction, the improvement that said guitar comprises elevation adjusting means for adjusting the elevation of said locking member relative to the said guitar body.

2. A guitar according to claim 1, wherein said elevation adjusting means includes a manually operable adjustment member.

3. A guitar according to claim 1, wherein said locking member includes an elongated engaging portion adapted to engage the bottom of said tremolo base plate, and the engaging portion of said locking member is tapered to facilitated such engagement.

4. A guitar according to claim 1, further comprising holding means for selectively holding said locking member in its engaged position in engagement with said tremolo base plate and in its disengaged position out of engagement with said tremolo base plate.

5. A guitar according to claim 4, wherein said holding means comprises at least one pole magnet.

6. A guitar according to claim 5, wherein said holding means comprises a pair of pole magnets.

7. A guitar according to claim 2, wherein said locking member includes an elongated engaging portion adapted to engage the bottom of said tremolo base plate, and the engaging portion of said locking member is tapered to facilitate such engagement.

8. A guitar according to claim 7, wherein said locking member includes a detent.

* * * * *

UNITED STATES PATENT AND TRADEMARK OFFICE

CERTIFICATE OF CORRECTION

PATENT NO. : 4,882,967

DATED : November 28, 1989

INVENTOR(S) : Floyd D. Rose

It is certified that error appears in the above-identified patent and that said Letters Patent is hereby corrected as shown below:

Column 2, line 59, "aperspective" should read --a perspective--.

Column 2, line 60, after "of" insert --the present--.

Column 8, line 40, "facilitated" should read --facilitate--.

Column 8, line 41, after "claim 1," insert --2 or 3,--.

Signed and Sealed this

Eighth Day of January, 1991

*Attest:*

HARRY F. MANBECK, JR.

*Attesting Officer*

*Commissioner of Patents and Trademarks*